US007782158B2

(12) United States Patent
Wiehler

(10) Patent No.: US 7,782,158 B2
(45) Date of Patent: Aug. 24, 2010

(54) PASSBAND RESONATOR FILTER WITH PREDISTORTED QUALITY FACTOR Q

(75) Inventor: Eric Wiehler, Sandown, NH (US)

(73) Assignee: Andrew LLC, Hickory, NC (US)

( * ) Notice: Subject to any disclaimer, the term of this patent is extended or adjusted under 35 U.S.C. 154(b) by 93 days.

(21) Appl. No.: 11/735,558

(22) Filed: Apr. 16, 2007

(65) Prior Publication Data

US 2008/0252399 A1 Oct. 16, 2008

(51) Int. Cl.
*H01P 1/20* (2006.01)

(52) U.S. Cl. ..... 333/202; 333/203; 333/219.1

(58) Field of Classification Search ..... 333/202–203, 333/219.1

See application file for complete search history.

(56) References Cited

U.S. PATENT DOCUMENTS

| | | | | | |
|---|---|---|---|---|---|
| 4,241,323 | A | | 12/1980 | Griffin et al. | |
| 4,423,397 | A | * | 12/1983 | Nishikawa et al. | 333/219.1 |
| 4,626,809 | A | * | 12/1986 | Mizumura et al. | 333/202 |
| 4,881,050 | A | | 11/1989 | Swanson | |
| 5,175,518 | A | | 12/1992 | Swanson | |
| 5,220,300 | A | * | 6/1993 | Snyder | 333/210 |
| 5,440,281 | A | * | 8/1995 | Wey et al. | 333/126 |
| 5,608,363 | A | * | 3/1997 | Cameron et al. | 333/202 |
| 5,760,667 | A | | 6/1998 | Young et al. | |
| 5,841,330 | A | * | 11/1998 | Wenzel et al. | 333/202 |
| 5,888,942 | A | | 3/1999 | Matthaei | |
| 5,894,250 | A | * | 4/1999 | Ravaska et al. | 333/134 |
| 6,002,311 | A | * | 12/1999 | Wey et al. | 333/219.1 |
| 6,026,311 | A | | 2/2000 | Willemsen Cortes et al. | |
| 6,075,427 | A | | 6/2000 | Tai et al. | |
| 6,081,175 | A | * | 6/2000 | Duong et al. | 333/212 |
| 6,255,917 | B1 | * | 7/2001 | Scott | 333/202 |
| 6,476,693 | B1 | * | 11/2002 | Snyder et al. | 333/219.1 |
| 6,633,208 | B2 | | 10/2003 | Salkola et al. | |
| 6,873,222 | B2 | * | 3/2005 | Mansour | 333/99 S |
| 6,882,251 | B2 | * | 4/2005 | Yu et al. | 333/202 |
| 7,075,392 | B2 | * | 7/2006 | Smith et al. | 333/202 |
| 7,352,264 | B2 | * | 4/2008 | Schwab et al. | 333/203 |
| 2005/0200435 | A1 | * | 9/2005 | Pance et al. | 333/202 |
| 2005/0270120 | A1 | * | 12/2005 | Guo | 333/134 |

* cited by examiner

*Primary Examiner*—James H. Cho
*Assistant Examiner*—Jason Crawford
(74) *Attorney, Agent, or Firm*—Wood, Herron & Evans, LLP

(57) ABSTRACT

A filter for processing an RF signal includes an input port and an output port and a plurality of resonators. The resonators are arranged in a sequentially-coupled arrangement between the input and output ports to affect an RF signal therebetween. Each resonator includes a cavity and resonant element. The resonant elements of at least two resonators are made of two different types of materials to effect higher and lower Q factors for the resonators. The resonators are arranged to provide at least one resonator having a lower Q factor proximate one of the input and output ports while the higher Q factor resonator is provided proximate the inside of the sequentially-coupled arrangement.

25 Claims, 7 Drawing Sheets

PASSBAND RESONATOR FILTER WITH PREDISTORTED QUALITY FACTOR Q

FIELD OF THE INVENTION

This invention relates generally to RF communication systems and particularly to RF filters used in such systems.

BACKGROUND OF THE INVENTION

Filters play an important role in many telecommunication systems, such as wireless cellular systems, for example. In one application, bandpass filters are utilized to transmit energy in a desired band of frequencies (i.e., the passband) and to reject energy at unwanted frequencies (i.e., the stopband) that are outside of the desired band or passband. In use, and in a transmit or receive function, multiple bandpass filters may be utilized to divide up the entire receive or transmit band into smaller sub-bands for further processing.

One type of bandpass filter utilizes resonators, such as cavity resonators, that are cascaded together to form a multipole filter. Such resonator filters, and their characteristics, are often indicated by a quality factor or Q rating. Since the characteristics of a single filter can have a significant impact on the overall performance of the larger communication system, it is desirable to achieve the most ideal response possible in the filter. One of the major performance limitations is the unloaded Q factor of the resonators.

In addition to maintaining a desirable passband and significant rejection at the stopband, one other performance criterion that is important within a bandpass resonator filter is the amount of bandpass ripple or the loss variation in the filtered signal. Bandpass ripple or loss variation refers to the situation where the filter has more insertion loss at the band edges of the passband than it has at the band center or center frequency of the passband. While a theoretical resonator filter might have resonators with infinite Q, in constructing such resonators and implementing them into real filter applications, they have a finite Q. Filters using resonators of finite, uniform unloaded Q have a certain amount of passband ripple that needs to be reduced to meet desirable system requirements.

One technique for addressing such passband ripple is to utilize predistorted Q in the filter. Predistorted Q refers to a filter design technique wherein the resonator Q is not equal or uniform for all the resonators that are used throughout the filter. To realize an equal ripple passband, which is desirable, the filter transmission poles need to be placed in specific locations on the S plane. Finite resonator Q shifts the poles on the real axis, causing ripple distortion, which results in band edge roll-off. Predistorted Q allows the transmission poles to be placed such that their relative positions are generally identical to the infinite Q positions, but with a relative shift on the real axis. The predistorted Q may thus be utilized to realize a flatter passband ripple.

While various predistorted Q techniques are utilized for filter construction, it is still desirable to improve upon such techniques and to provide predistorted Q within a filter using resonators such that the size and the cost of the filter is not significantly high or prohibitive.

It is further desirable to provide a filter configuration that is adaptable to provide a number of different filters with complex filter functions. The complex functions should be realizable while still controlling passband insertion loss as noted. Furthermore, cost savings are a factor for consideration in any such filter design.

BRIEF DESCRIPTION OF THE DRAWINGS

The accompanying drawings, which are incorporated in and constitute a part of this specification, illustrate components and embodiments of the invention and, together with the detailed description of the embodiments given below, serve to explain the principles of the invention.

DETAILED DESCRIPTION OF EMBODIMENTS OF THE INVENTION

Figure 1:
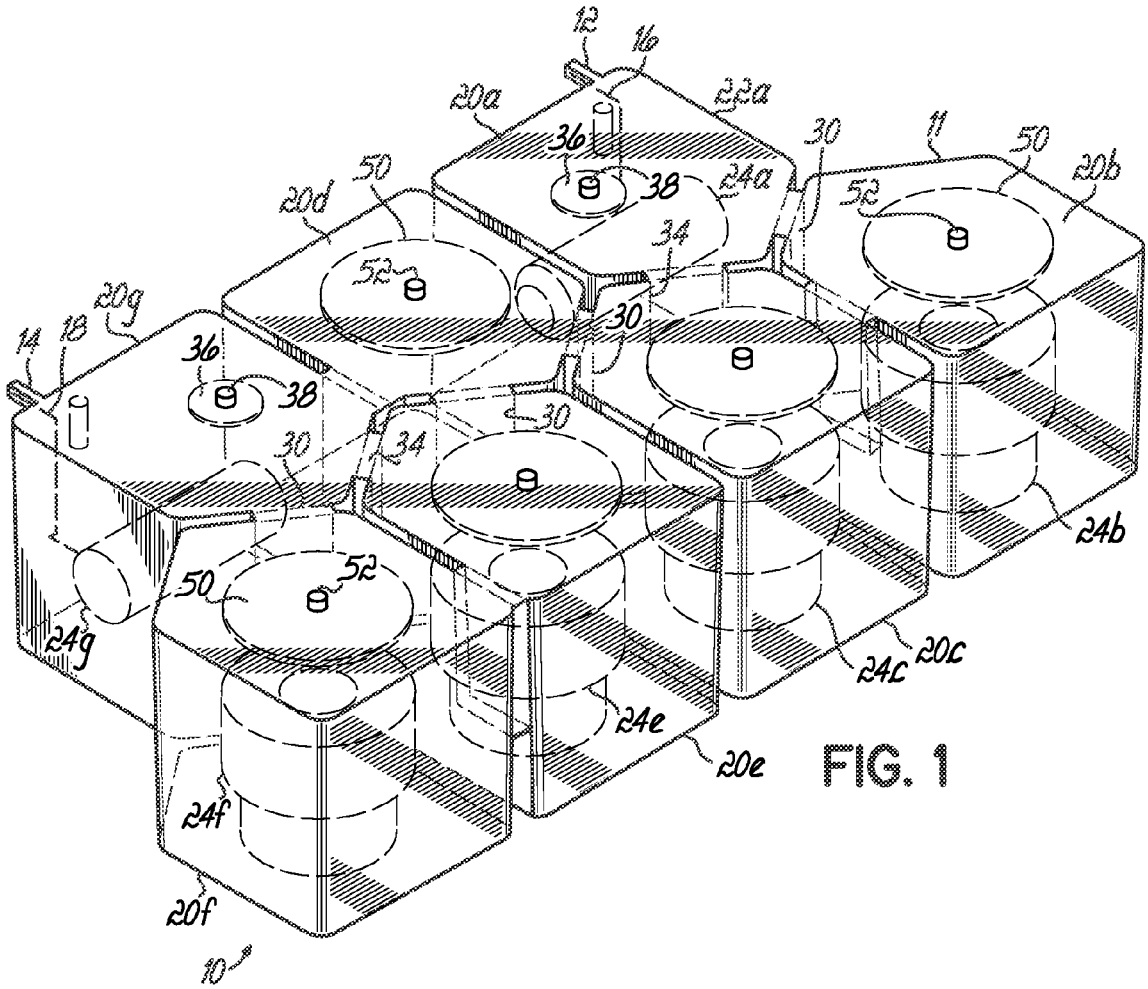
FIG. 1 is a perspective view of a filter implementing an embodiment of the present invention.

FIG. 1 illustrates a filter 10 incorporating an embodiment of the present invention. Filter 10 might be utilized for various particular filtering applications, such as in an RF communications system, and specifically might be utilized as a bandpass filter, although the invention and its various features and aspects are not limited to only bandpass filters, and, thus, will be applicable to other filters as well. Filter 10 incorporates a plurality of resonators that are serially or sequentially coupled together for filtering a signal. For the purposes of discussion, those resonators that are sequentially next to each other, such as 1-2, 2-3, 3-4, and so forth, are also considered adjacent resonators. In various embodiments of the invention, as discussed herein, cross-coupling might also be utilized between various of the non-adjacent resonators, although the overall invention is not limited to requiring such cross-coupling between non-adjacent resonators.

Filter 10 utilizes an input or input port 12 and an output or output port 14 such that a signal introduced at input port 12 is filtered, pass through the coupled resonators, and is output at port 14. For coupling an appropriate RF signal to filter 10, the input port 12 may include a suitable tap line 16 that is electrically coupled with one or more components of one of the resonators, such as the first sequential resonator. Similarly, at the output port 14, a tap line 18 is utilized for handling the output signal for being passed to other components (not shown) in an overall system.

The present invention is not limited to a specific number of resonators that are coupled together, and the number of such resonators in a bandpass filter will be dependent upon the specific filter design, as well as the desired transfer function, bandwidth, center frequency, and other factors in the filter design. In one of the embodiments illustrated in the drawings and discussed herein, seven resonators are utilized, which are indicated as 20*a*, 20*b*, 20*c*, 20*d*, 20*e*, 20*f* and 20*g*, as an illustrative example. Other embodiments have fewer resonators, but more could be used as well. The resonators 20*a*-20*g* utilized in the illustrated embodiment each include an assembly incorporating a housing 22 and an internal resonant element 24. For designating the specific resonators 20*a*-20*g* in the illustrated embodiment, the housings will be indicated as 22*a*-22*g* and the respective internal resonant elements as 24*a*-24*g*.

In accordance with one aspect of the present invention, filter 10 utilizes multiple different types of resonators for improving the characteristics of the filter. One particular desirable feature of the present invention is the reduction of the passband ripple, as discussed above, although the filter 10 provides other desirable features in accordance with the present invention. Specifically, in the illustrated embodiment, filter 10 incorporates a combination of metal resonators and ceramic resonators. Generally, the reference to a "metal" resonator or "ceramic" resonator is specifically directed to the type of material forming the internal resonant elements or posts 24*a*-24*g* utilized in the resonator.

Specifically, in one illustrated embodiment, the input resonator 20*a*and the output resonator 20*g* of filter 10 are utilized to have the lowest weighting or lowest Q. In the illustrated embodiment, those resonators have internal elements 24*a*, 24*g* that are metal. One or more of the middle resonators or internal resonators 20*b*-20*f* of the filter incorporate ceramic resonant elements, such as elements 24*b*-24*f*. The metal resonators have a substantially lower unloaded Q than the ceramic resonators. The combination of different types of resonators, and in the illustrated embodiment, the combination of metal resonators and ceramic resonators, provide the desired predistorted Q and bandpass flattening effect to the passband ripple and also provide other improved characteristics to the filter 10 in accordance with the invention. Furthermore, the filter provides cross-coupling between metal and ceramic resonators.

The present invention is not limited to using one type of lower Q resonator, which is a metal resonator, only for the first and last resonators 20*a*, 20*g*, respectively, and then using different types of resonators, such as ceramic resonators, for the internal resonators, 20*b*-20*f*, as illustrated. Alternatively, the first type of low Q resonator, such as a metal resonator, might extend into the filter and past the first resonator. For example, in an alternative embodiment, resonator 20*b*or 20*c* might also be a low Q metal resonator.

Furthermore, it is not necessary that the design be symmetric such that both of the end resonators 20*a*, 20*g* are the same type of resonator. For example, only the first resonator 20*a* might be one particular type, such as a metal resonator, while the other resonators 20*b*-20*g* are of another type. It is desirable to put the lower Q resonators on an end or both ends of the filter and the higher Q resonators in the middle in accordance with one aspect of the invention, wherein lower Q metal resonators are used on the ends and higher Q ceramic resonators are used in the middle as illustrated in the embodiment shown in the figures.

Referring again to FIGS. 1 and 2, filter 10 includes a housing structure 11, which is made up of what might be considered individual housings 22*a*-22*g* of the various resonators. The housings or housing elements 22 operate together to form an overall housing 11 for the filter. Depending upon the coupling, each of the successive serial resonators 20*a*-20*g* are coupled together. That is, the various resonators are serially coupled together by appropriate coupling apertures or irises in the respective housings.

Figure 2:
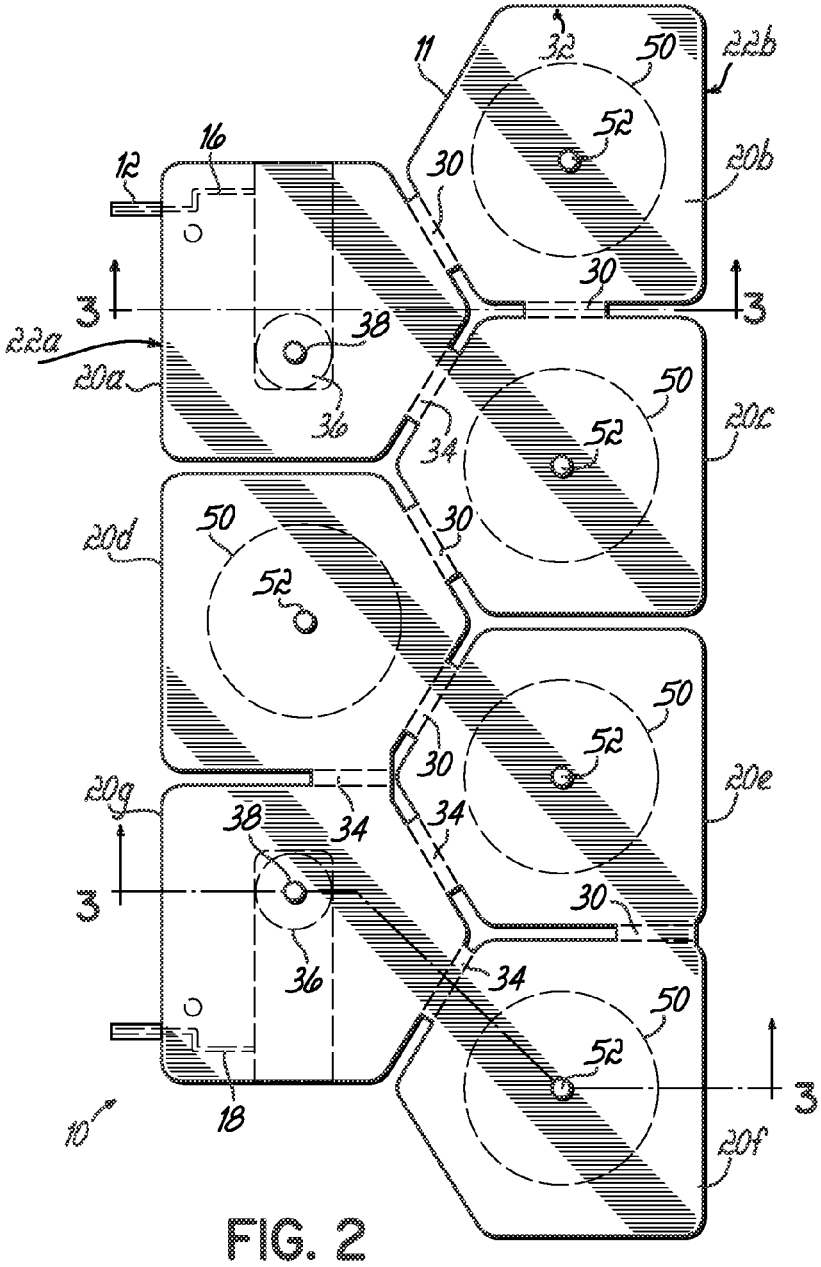
FIG. 2 is a top view of the filter of FIG. 1.

Referring to FIG. 2, resonator 20*a* is directly coupled to adjacent resonator 20*b*, resonator 20*b* is directly coupled to adjacent resonator 20*c*, and so forth, until resonator 20*f* is directly coupled to adjacent resonator 20*g*. Specifically, as illustrated in FIG. 2, a coupling aperture 30 spans between resonators 20*a* and 20*b*. The coupling aperture 30 is an opening formed in the respective housing walls 32 of the respective housings 22*a*, 22*b*. Similarly, other coupling apertures 30 are shown coupling the respective adjacent resonators to each other in sequential fashion going from resonator 20*a* to resonator 20*g*. As shown in FIG. 2, a coupling juncture 30 spans between each of the sequential resonators.

In accordance with another aspect of the invention, cross-coupling might also be utilized so as to cross-couple a specific resonator to a non-adjacent resonator. For example, while resonator 20*c* utilizes coupling apertures 30 to directly couple to the preceding adjacent resonator 20*b* and to the following adjacent resonator 20*d*, resonator 20*c* also utilizes a cross-coupling aperture 34 to couple to non-adjacent resonator 20*a* as well. Similarly, other of the resonators may cross-couple to respective non-sequential or non-adjacent resonators utilizing cross-coupling aperture 34. For example, resonator 20*d* also cross-couples to resonator 20*g* through aperture 34 and resonator 20*e* also cross-couples to resonator 20*g*. The present invention is not limited to the specific coupling apertures or irises 30 and cross-coupling apertures or irises 34 as illustrated in the embodiment of the figures to provide the desired coupling and cross-coupling between resonators. Rather, other different coupling and cross-coupling techniques might also be utilized. For example, coupling probes might be used.

The coupling apertures 30 and cross-coupling apertures 34 are created by appropriate openings that are formed in respective housing walls 32 between the resonators. The openings are dimensioned and positioned so as to provide the necessary coupling of energy between the resonators at the desired frequencies of the filter 10. The overall housing 11 of the filter might be formed from individual housings 22 coupled together or might be a unitary structure with the desired housing features and apertures 30, 34 that are formed in accordance with the invention. For example, aluminum might be utilized to form the overall housing 11 or individual housings 22 of filter 10. As may be appreciated, the housings 22 form the cavities of the resonator and thus are formed of aluminum, as noted, or some other suitable metal. Furthermore, they might be silver-plated or plated with some other conductive metal on the inside of each housing for better conductance.

The coupling apertures 30, 34 are appropriately sized based upon the bandwidth of the filter, the center frequency of the filter, the number of resonators that are utilized, as well as the number of transmission zeros that are to be achieved in the filter and the positioning of those transmission zeros. As noted, while the illustrated figures show the coupling junctures as apertures formed in the respective housings and cavities of the resonators, probe-type structures (not shown) might also be utilized to pass energy between the sequential resonators, as would be understood by a person of ordinary skill in the art.

Turning now to the internal elements of the resonators 20*a*-20*g*, each resonator includes an internal resonant element 24, which is contained within the cavity formed by the respective housing 22 of the resonator. In those resonator elements that are considered "metal" resonators in accordance with one aspect of the invention, the internal resonant element 24 is formed of metal. For example, as illustrated in FIGS. 1 and 2, resonant element 24*a* is formed of a metal rod-like structure that could be solid or hollow. The metal rod structure may be made of a suitably conductive metal such as steel, brass, aluminum or copper and might be plated with one or more highly conductive metals, such as gold, copper or silver. Resonant element 24*a* couples energy into the cavity of the resonator 20*a*.

Figure 3:
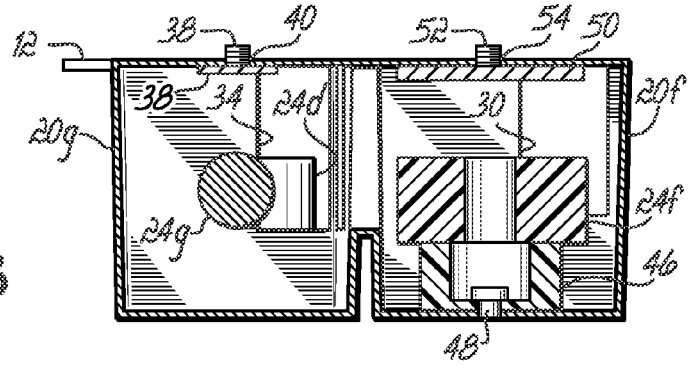
FIG. 3 is a cross-sectional view along lines 3-3 of FIG. 2.

For tuning purposes, a tuning element 36 might be utilized with resonator 20*a*. The tuning element embodiment illustrated in the figures of the present application is in the form of a tuning button that moves up and down with respect to the resonator element in the cavity. Turning to FIG. 3, the tuning button 36 is shown coupled to a threaded rod 38. The threaded rod moves through a threaded opening 40 that is formed in the top wall or roof 42 of the resonator housing 22. The cross-section of FIG. 3 is a cross-section of the metal resonator 20*g* and ceramic resonator 20*f*. However, in the illustrated embodiment, the resonator 20*a* and adjacent resonator 20*b* are similarly fashioned. By turning the threaded rod, the button 36 may be adjusted up and down in relation to its respective internal resonator element 24*a*, 24*g* in order to tune the particular resonator. Turning now to the construction of the ceramic resonator embodiments shown in the figures, FIG. 3 illustrates a cross-section of resonator 20*f*, which incorporates a ceramic resonant element 24*f*. Resonant element 24*f* is formed of a ceramic material or other high dielectric material. In the illustrated embodiment discussed herein, the resonant element 24*f*, as well as other resonator elements in resonators 20*b*, 20*c*, 20*d* and 20*e* are in the form of a ceramic doughnut that is supported on an appropriate pedestal element 46. The pedestal could be a solid or cylindrical element or cup shape as illustrated in the figures. It might be secured to respective housing 22 with a suitable fastener 48. Pedestal 46 is positioned to provide support and positioning for the ceramic resonator elements 24 in the center of the cavity or elsewhere. The pedestals 46 are non-conductive and might be formed of a suitable material such as Alumina, Nylon, Teflon, or plastic. Also within the ceramic resonators 20, a tuning button 50 is utilized on a threaded shaft 52 that passes through a suitable threaded hole 54 in the housing roof or top wall 42 of a respective cavity. Thereby, the tuning button 50 may be rotationally adjusted with respect to its facing from respective internal resonant element 24 in order to tune the resonator.

Figure 4:
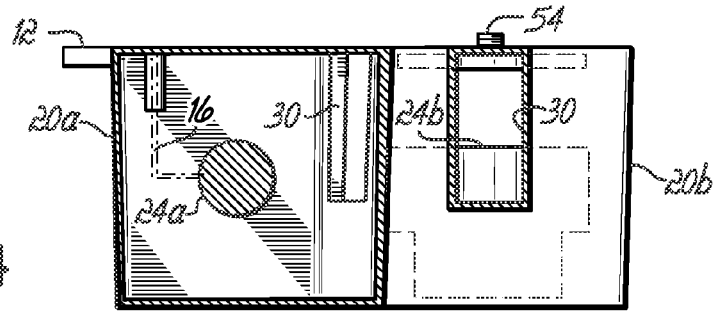
FIG. 4 is a cross-section view along lines 4-4 of FIG. 2 showing components of the filter in FIG. 1.

FIG. 4 is another cross-section of the filter 10 of FIG. 1 along lines 4-4 showing direct coupling apertures 30 between resonators 20*a*, 20*b*, and 20*c*. As noted, the apertures may be adjusted in dimension and positioning between the resonator cavities for the desired frequency and coupling operation. Also, other coupling techniques, such as probes, might be used.

Figure 5:
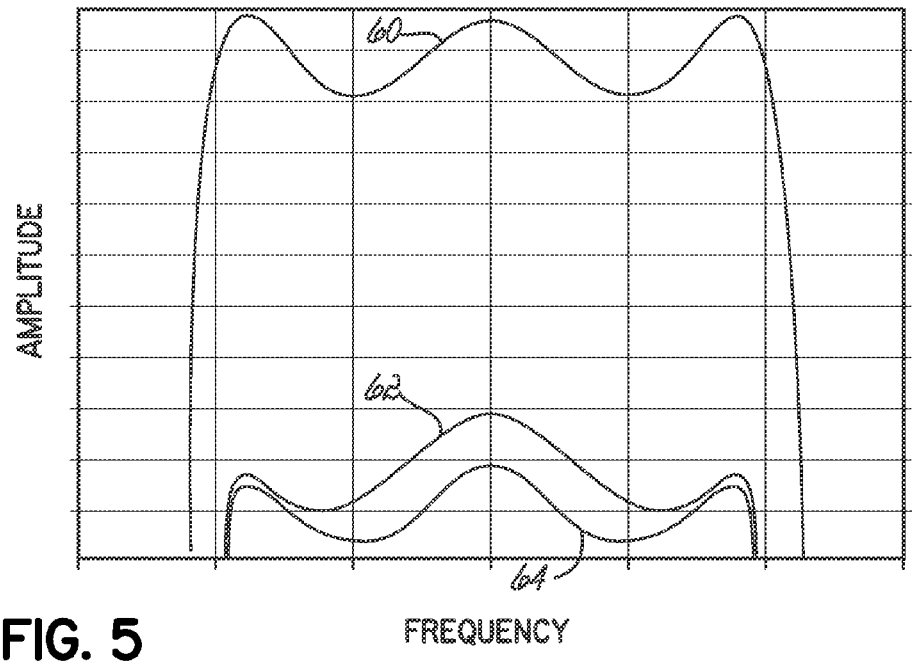
FIG. 5 is a graph of a passband showing examples of infinite Q, uniform Q and predistorted Q, respectively.
Figure 6:
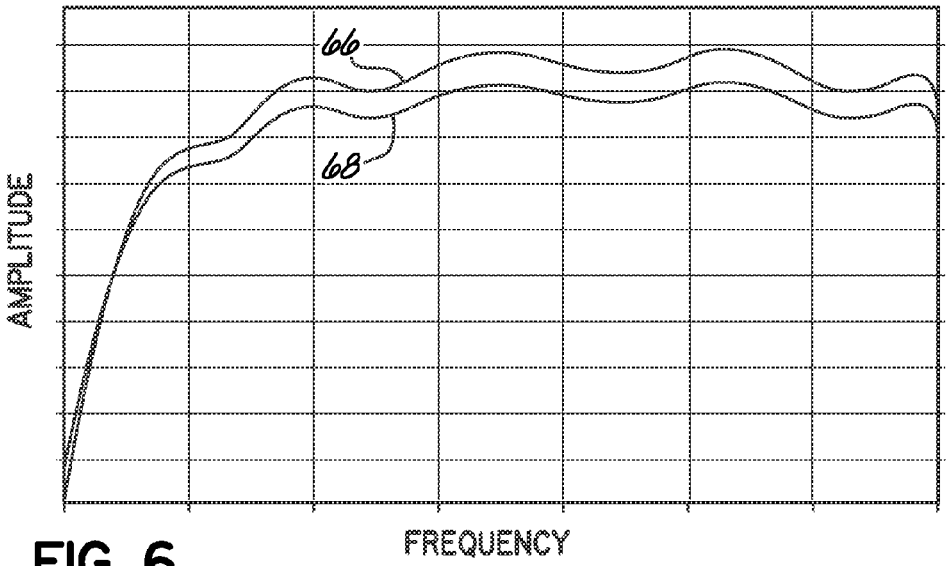
FIG. 6 is a graph of part of a passband response illustrating the desirable effects of the present invention.

FIGS. 5 and 6 illustrate the effects of the improvements in the bandpass signal provided by the invention. Specifically, FIG. 5 generally illustrates a three pole filter example and the effect of a predistorted Q on the bandpass signal. The graph 60 illustrates a theoretical example of a three pole filter with infinite Q. Graph 62 illustrates the three pole example of non-infinite, but uniform, Q. Finally, graph 64 indicates the effect of predistorted Q in the flattening of the passband signal.

Turning to FIG. 6, the trace 66 illustrates the effect of the disclosed embodiment utilizing seven resonators each having an unloaded and uniform Q of 20,000. In the amplitude versus frequency chart, the passband flatness is approximately +/−0.47 dB. Trace 68, on the other hand, utilizes five middle resonators at an unloaded Q of 25,000 and the two end resonators at a lower unloaded Q of 4,500 in accordance with the present invention. This results in a passband flatness of +/−0.36 dB.

Figure 7:
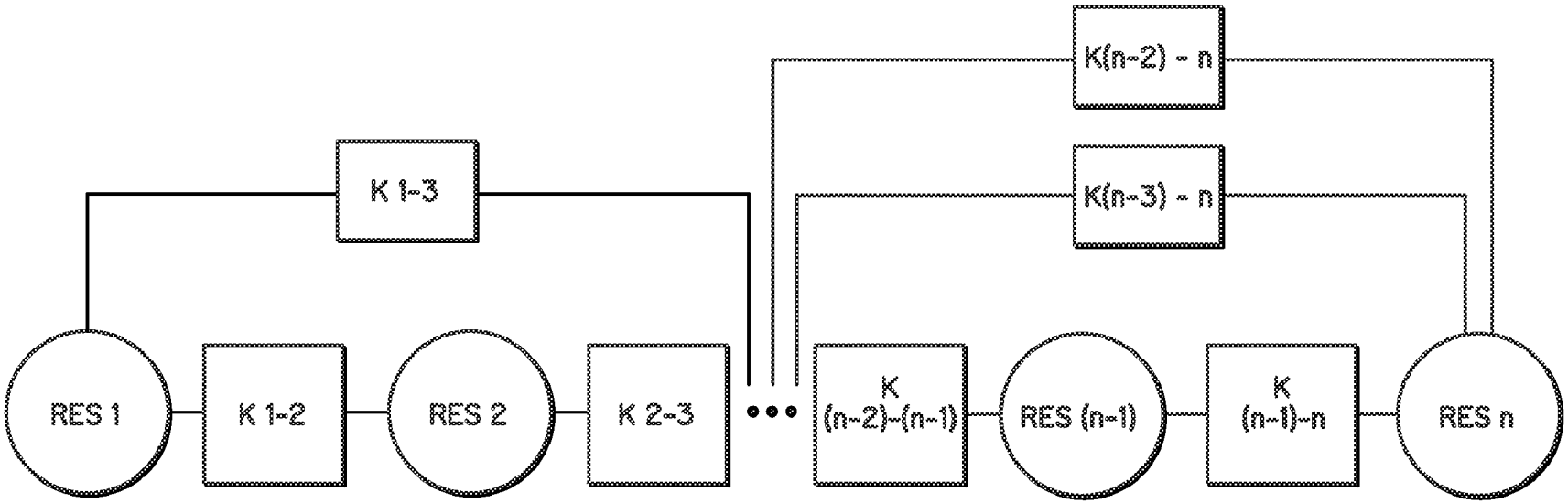
FIG. 7 is a schematic view of resonators and coupling features of one embodiment of the present invention.

FIG. 7 illustrates a schematic block diagram of the coupled and cross-coupled resonators of an inventive filter as shown in the figures. As noted above, the present invention is not limited to the specific number of resonators (e.g., seven) that are illustrated in the one embodiment discussed herein. Rather, any number of suitable resonators might be utilized. Such resonators are indicated in FIG. 7 as RES 1-RES n. The various couplings are indicated by elements K. FIG. 7 illustrates the main couplings between the sequential or adjacent resonators in K 1-2, K 2-3, etc. Cross-couplings between non-adjacent resonators are also indicated, such as in K 1-3, K (n-2)-n, K (n-3)-n, etc.

Accordingly, a filter, such as a bandpass filter, is illustrated and described that has sequentially-coupled resonators between input and output ports wherein the resonators are made of two different types of materials to effect higher and lower Q factors. The resonators are arranged to provide at least one resonator having a lower Q factor proximate one of the input and output ports while the higher Q factor resonator is provided proximate the inside of the sequentially-coupled arrangement.

FIGS. 8, 9*a*-9*b*, 10, 11*a*-11*c* disclose other embodiments of a filter structure in accordance with further aspects of the invention.

Specifically, the embodiments set forth filters with combinations of resonators wherein at least one of the resonators is metal and at least one other resonator is ceramic. Furthermore, such embodiments also illustrate cross-coupling of non-adjacent resonators and at least one cross-coupling from a metal resonator to a ceramic resonator. Specifically, FIG. 8 discloses a filter or filter section 100 utilizing three resonators 102, 104, 106. It should be noted that the embodiments disclosed in FIGS. 8-11*c* may operate individually as filters or may be coupled together with other pluralities of resonators to form an overall filter. Each of the resonators 102, 104, and 106 are configured somewhat similarly to the resonators previously discussed herein and include housings 108, 110, and 112, along with internal resonant elements 114, 116, 118. At least one of the resonant elements, such as resonant element 114, is a metal resonant element and at least one other of the resonant elements, such as elements 116, 118, are ceramic elements. The metal and ceramic resonant elements 114, 116, and 118 may be appropriately formed as discussed hereinabove with respect to the embodiments illustrated in FIGS. 1-4.

In accordance with one aspect of the invention, in addition to direct coupling between the sequential, adjacent resonators, there is also at least one cross-coupling between a metal resonator and a ceramic resonator. That is, there is a cross-coupling between at least one resonator incorporating an internal resonant element made of metal and another resonator incorporating an internal resonant element made of ceramic.

Figure 8:
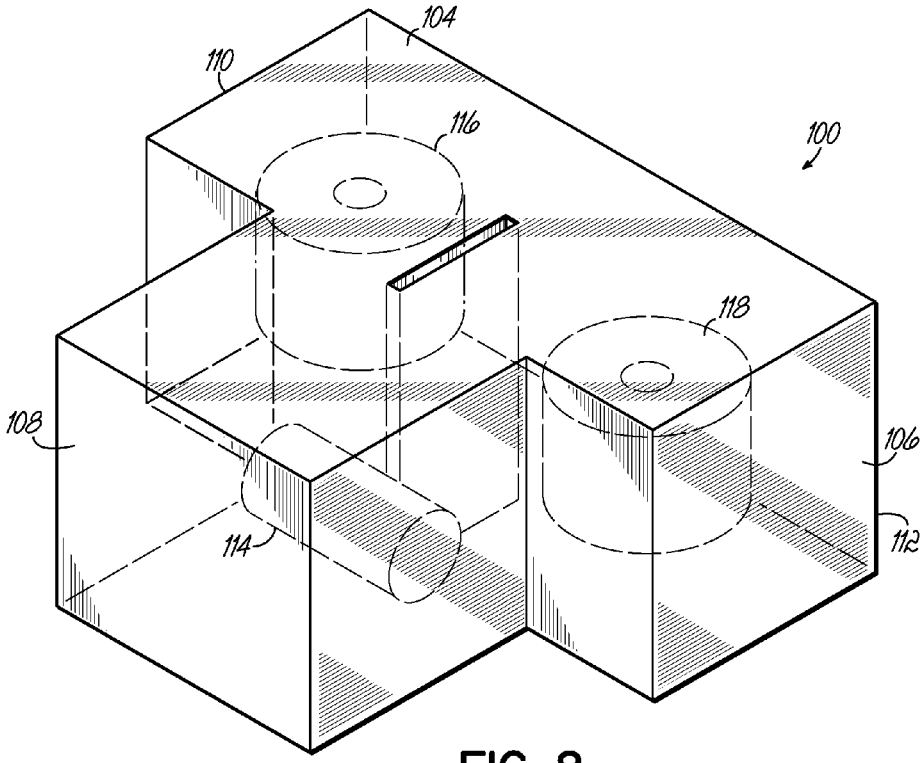
FIG. 8 is a schematic view of another embodiment of a filter for implementing aspects of the present invention.
Figure 9A:
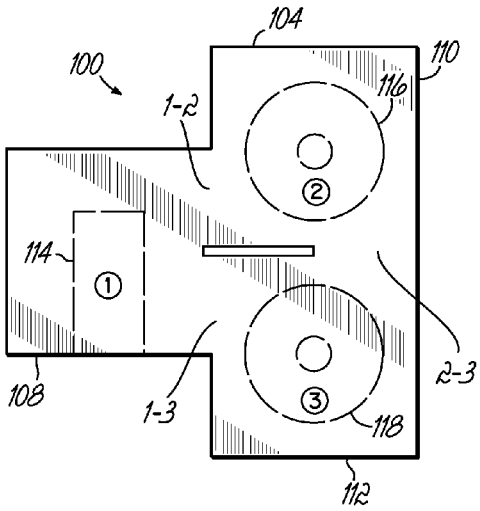
FIG. 9*a* is a top view of the filter of FIG. 8.

Referring to FIGS. 8 and 9*a*, a top view of filter 100 is illustrated showing resonators 102, 104, and 106. For the purpose of discussion, and also carrying over into other illustrated embodiments in FIGS. 9*b*-11*c*, the resonators are designated as resonators 1, 2, and 3, whereas, the couplings and cross-couplings are designated as (1-2), (2-3), and (1-3). Referring specifically to FIG. 9*a*, there is an adjacent resonator coupling between resonators 1 and 2 indicated as (1-2) and between resonators 2 and 3 indicated as (2-3). In addition, there is a cross-coupling between resonators 1 and 3 indicated as (1-3). The various couplings and cross-couplings are provided by openings between the walls of the resonator housings 108, 110, and 112.

In accordance with one aspect of the present invention, the metal resonant element 114 is positioned in various different orientations within the filter, and specifically within its own housing 108, and the various coupling and cross-coupling openings are oriented between adjacent resonators in order to provide a variety of different characteristics in a variety of different implementations for filter 100, as discussed herein, such that filter 100, and the other discussed filters, may be utilized in filters having a larger number of resonators. By providing specifically oriented resonant elements 114,116, and 118, as well as specifically oriented coupling openings (1-2), (2-3), and (1-3), finite transmission zeros may be produced as desired. In the illustrated embodiments, adjacent resonators are coupled together and some non-adjacent resonators are also coupled or cross-coupled to produce the finite transmission zeros. As noted, those couplings are implemented with openings (e.g., irises or apertures) located between the resonator housings where coupling is desired.

In accordance with one aspect of the invention, there will be at least two non-adjacent resonators made of different materials and cross-coupled with each other. More specifically, there is at least one cross-coupling from a metal resonator to a ceramic resonator. In several of the disclosed embodiments, the position of the coupling or cross-coupling aperture with respect to the metal resonator controls the sign of the cross-coupling between resonators. For example, referring to FIG. 9*a*, there are adjacent resonator couplings between resonators 1 and 2 (1-2) and resonators 2 and 3 (2-3). In addition, there is a cross-coupling between resonators 1 and 3. The sign of the cross- coupling (1-3) relative to the adjacent couplings is negative and this produces a finite transmission zero that is below the specific passband of the filter 100. It will be readily understood by a person of ordinary skill in the art that the orientation of the various electric and magnetic fields associated with the cited resonator elements, and the positioning and orientation of housing apertures with respect to the internal metal and ceramic resonator elements will dictate the characteristics of the filter 100.

Figure 9B:
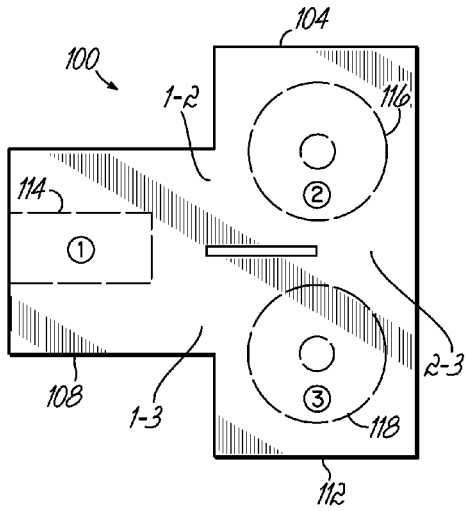
FIG. 9*b* is a top view of an alternative embodiment of a filter in accordance with aspects of the invention.

The embodiment of FIG. 9*b* is illustrated in a top view similar to FIG. 9*a* and incorporates resonator elements similar to those discussed with respect to FIGS. 8 and 9*a*. However, one particular difference is that the internal resonant element of resonator 1 is oriented in a different position with respect to its housing and also with respect to the coupling and cross-coupling apertures. Specifically, there are adjacent resonator couplings between resonators 1 and 2 (1-2) and resonators 2 and 3 (2-3). In addition, there is a cross-coupling between non-adjacent resonators 1 and 3 designated as (1-3). However, due to the positioning of the internal resonant element 114 of resonator 1, the cross-coupling relative to the adjacent couplings is positive. This produces a finite transmission zero that is above the specific passband of the filter 100*a*.

Figure 10:
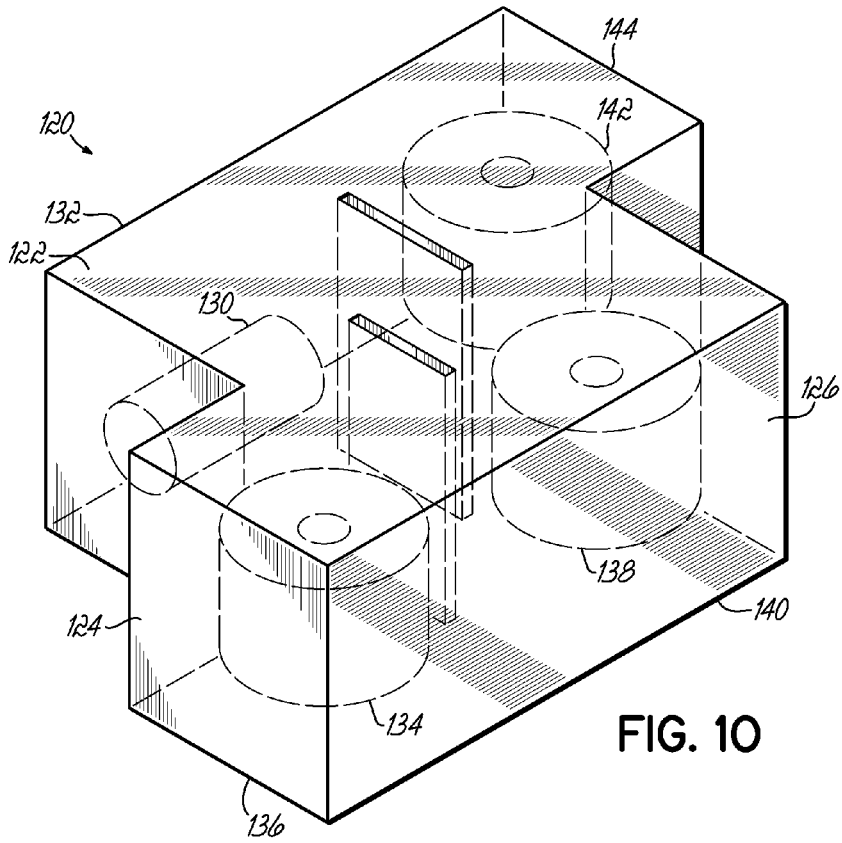
FIG. 10 is a schematic view of another embodiment of a filter for implementing aspects of the present invention.
Figure 11A:
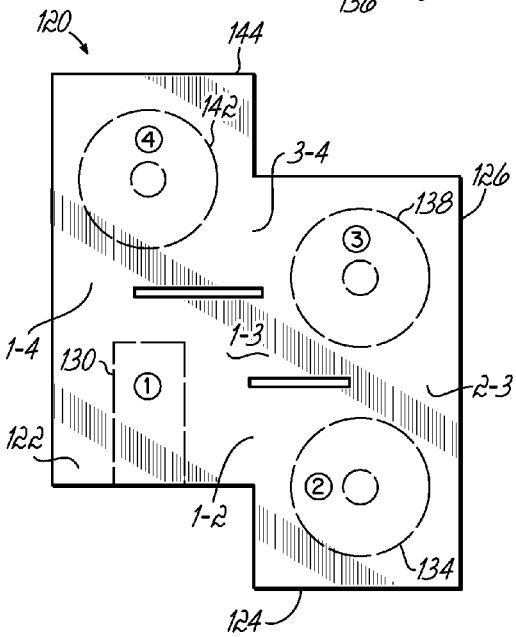
FIG. 11*a* is a top view of the filter of FIG. 10.

FIGS. 10 and 11A-11C illustrate still further embodiments of filters, which incorporate resonators made of different materials and having cross-couplings between the different resonators. Those embodiments illustrate filters with four resonator elements, including at least one metal resonator and one ceramic resonator wherein there is at least one cross-coupling between metal and ceramic resonators. Referring now to FIG. 10, filter 120 utilizes resonators 122, 124, 126, and 128. Each of those resonators includes a respective internal resonant element 130,1 34,1 38, and 142, and a housing 132, 136, 140, and 144. The walls of the housing separate the individual and sequential resonators 122, 124, 126, and 128, and the apertures or irises are indicated as couplings or cross-couplings (1-2), (2-3), (3-4), and (1-4). As set forth in FIG. 9*a*, the resonators are indicated as 1, 2, 3, and 4, for the purposes of discussion, as illustrated in FIG. 11A.

In the quad resonator filter 120, as illustrated in FIG. 11A, there are couplings between adjacent resonators 1 and 2, resonators 2 and 3, and resonators 3 and 4. In addition, there are cross-couplings between non-adjacent resonators 1 and 3 (1-3) and resonators 1 and 4 (1-4). Due to the positioning of the apertures that provide such cross-couplings between the resonator housings 132, 136, 140, and 144, the sign of the (1-3) cross-coupling, relative to the other adjacent couplings (1-2), (2-3), and (3-4), is negative. Alternatively, the sign of the (1-4) cross-coupling, relative to those adjacent couplings, is negative. Such a configuration as illustrated in FIG. 11A will produce one finite transmission zero located below the passband of the filter 120 and one transmission zero above the passband. The transmission zero below the passband will be closer to the passband than the transmission zero above.

Figure 11B:
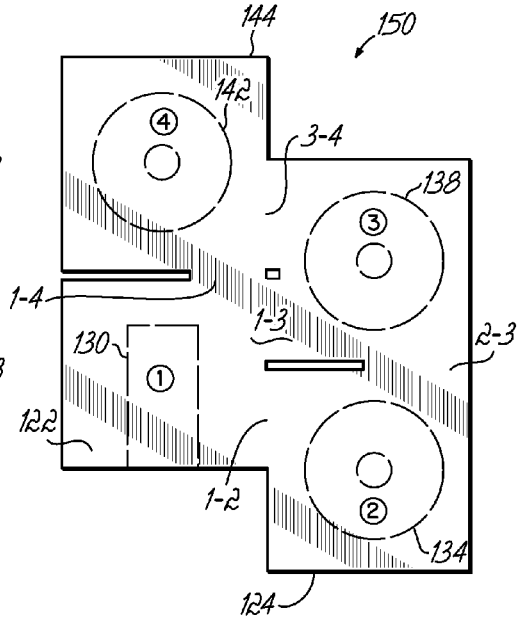
FIG. 11*b* is a top view of an alternative embodiment of a filter in accordance with aspects of the invention.
Figure 11C:
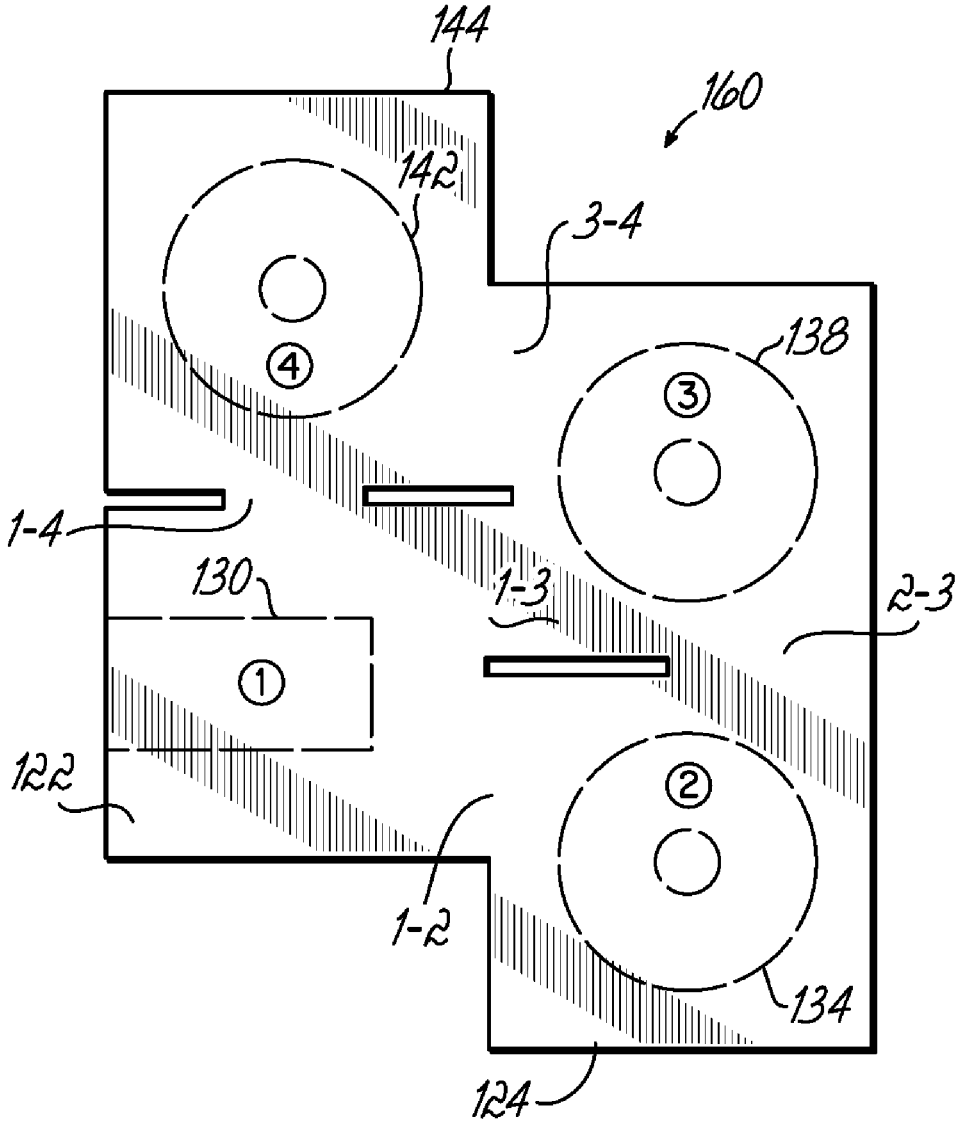
FIG. 11*c* is a top view of another alternative embodiment of a filter in accordance with aspects of the invention.

FIG. 11B illustrates another embodiment of a filter 150 incorporating resonators of different materials that are cross-coupled with each other. Filter 150 has at least one metal resonator, or a resonator incorporating an internal metal resonant element, indicated in FIG. 11B as numeral 1. Furthermore, filter 150 incorporates additional other resonators, at least one of those resonators being a different material, such as a ceramic resonator. In FIG. 11B three ceramic resonators indicated as reference numerals 2, 3, and 4 are shown. Similarly, the various coupling and cross-couplings between the resonator elements are indicated with like reference numerals to those shown in FIGS. 10 and 11A. The filter embodiment 150 shown in FIG. 11B utilizes a variation in the positioning of the coupling aperture for the cross-coupling (1-4) within the walls of the number 3 and number 4 resonators. Specifically, this affects the signs of the cross-coupling relative to the adjacent couplings. As in FIG. 11A, there are couplings between adjacent resonators set forth as (1-2), (2-3), and (3-4). There are also cross-couplings between non-adjacent resonators (1-3) and non-adjacent resonators (1-4). The sign of the (1-3) cross-coupling relative to the adjacent couplings is negative, similar to filter 120 of FIG. 11A. However, the sign of the (1-4) cross-coupling relative to the adjacent couplings is positive. This cross-coupling combination will produce two finite transmission zeros that are both located below the passband FIG. 11C utilizes a combination of metal and ceramic resonators in accordance with the principles of the invention and those resonators are numbered accordingly as shown in FIG. 11C. However, it may be noted that the positioning of resonator 1 with respect to the other resonators is varied as it pertains to those embodiments set forth in FIGS. 11A and 11B. That is, the internal element 130 is oriented differently. Furthermore, the aperture for the cross-coupling (1-4) is slightly varied with respect to its positioning in either FIG. 11A or 11B. However, as noted above with other embodiments, there are resonator couplings between the various adjacent resonators 1, 2, 3, and 4. Furthermore, there are cross-couplings between non-adjacent resonators 1 and 3 (1-3) and resonators 1 and 4 (1-4). Because of the unique configuration of the filter 160 shown in FIG. 11C, the sign of the (1-3) cross-coupling relative to the adjacent couplings is positive, and the sign of the (1-4) cross-coupling relative to the adjacent couplings is negative. This cross-coupling combination will produce one transmission zero below the passband and one above the passband. The transmission zero above the passband will be closer to the passband than the transmission zero below.

It should be noted that the illustrated embodiments herein showing a combination of different resonators (e.g., metal and ceramic resonators) within a filter, and also illustrating at least one cross-coupling between the different resonators or metal and ceramic resonators, are not meant to be exhaustive of the various possibilities and combinations, which might be incorporated in designing filters according to the present invention. For example, various different configurations both in the shape and material of the internal resonant elements, the shape and orientation of the resonator housings, the number of resonators, as well as the positioning of the various coupling and cross-coupling apertures might be varied. Generally, referring to the four resonator versions illustrated in FIGS. 10-11C, when both the (1-3) and (1 -4) cross-couplings are negative, transmission zeros will be above and below the passband, with the transmission zero that is below the passband closer to the passband than the zero that is above that passband (FIG. 11A). When the (1-3) cross-coupling is negative while the (1-4) cross-coupling is positive, as illustrated in FIG. 11B, both of the transmission zeros are below the passband. Somewhat similarly, when both of those cross-couplings are positive, both the transmission zeros are above the passband. As illustrated in FIG. 11C, when the (1-3) cross-coupling is positive and the (1-4) cross-coupling is negative, there is one finite transmission zero below the passband and one above the passband. The transmission zero above the passband will be closer to the passband than the transmission zero that is below that passband.

While the present invention has been illustrated by the description of the embodiments thereof, and while the embodiments have been described in considerable detail, it is not the intention of the applicant to restrict or in any way limit the scope of the appended claims to such detail. Additional advantages and modifications will readily appear to those skilled in the art. Therefore, the invention in its broader aspects is not limited to the specific details of representative apparatus and method, and illustrative examples shown and described. Accordingly, departures may be made from such details without departure from the spirit or scope of applicant's general inventive concept.

What is claimed:

1. A filter for processing an RF signal comprising:

an input port and an output port and a plurality of resonators;

the resonators arranged in a sequentially-coupled arrangement between the input and output ports to affect an RF signal there between;

each resonator including a cavity and resonant element;

the resonant elements of at least two resonators being made of two different types of materials to effect higher and lower Q factors for the at least two resonators;

the resonators being arranged to provide at least one resonator of the type of material having a lower Q factor proximate at least one of the input and output ports while a resonator of the type of material having a higher Q factor is provided proximate the inside of the sequentially-coupled arrangement and sequentially spaced from the input and output ports;

a lower Q material resonator that is proximate at least one of the input and output ports being coupled to a sequentially adjacent higher Q material resonator and also cross-coupled with at least one other higher Q material resonator that is proximate the inside of the sequentially-coupled arrangement and not sequentially adjacent with the lower Q material resonator proximate the input and output ports.

2. The filter of claim 1 further comprising multiple lower Q resonators and wherein the resonators are arranged to provide lower Q resonators proximate each of the input and output ports.

3. The filter of claim 1 further comprising multiple higher Q resonators provided proximate the inside of the sequentially-coupled arrangement.

4. The filter of claim 1 wherein at least some of the resonant elements are formed of metal and some are formed of a high dielectric material.

5. The filter of claim 4 wherein the metal resonant element is in the form of a rod.

6. The filter of claim 1 wherein the high dielectric material is a ceramic material.

7. The filter of claim 1 wherein at least two resonators are cross-coupled with each other.

8. The filter of claim 1 wherein the high dielectric material element is in the form of a donut.

9. A bandpass filter for processing an RF signal comprising:

a plurality of resonators arranged in a sequentially-coupled arrangement between input and output ports, each resonator including a cavity and resonant element;

the resonant elements of at least two resonators being made of two different types of materials to selectively present higher and lower Q factors for the at least two resonators; the resonators being arranged so that a resonator of the type of material having a lower Q factor is proximate at least one of the input and output ports and a resonator of the type of material having a higher Q factor is located inside of the sequentially-coupled arrangement and sequentially spaced from the input and output ports;

the lower Q material resonator that is proximate at least one of the input and output ports being coupled to a sequentially adjacent higher Q material resonator and also cross-coupled with at least one other higher Q material resonator that is proximate the inside of the sequentially-coupled arrangement and not sequentially adjacent with the lower Q material resonator proximate the input and output ports for reducing bandpass ripple in the RF signal.

10. The bandpass filter of claim 9 further comprising multiple lower Q resonators and wherein the resonators are arranged to provide lower Q resonators proximate each of the input and output ports.

11. The bandpass filter of claim 9 further comprising multiple higher Q resonators provided proximate the inside of the sequentially-coupled arrangement.

12. The bandpass filter of claim 9 wherein at least some of the lower Q factor resonant elements are formed of metal.

13. The bandpass filter of claim 9 wherein at least some of the higher Q factor resonant elements are formed of ceramic material.

14. A method of filtering an RF signal comprising:

presenting a signal at an input port to be filtered by a plurality of resonators arranged in a sequentially-coupled arrangement between the input port and an output port;

affecting the signal proximate at least one of the input port and the output port with a resonator being made of one type of material having a lower Q factor; and affecting the signal proximate the inside of the sequentially-coupled arrangement between the input and output ports with a resonator being made of another type of material having a higher Q factor relative the lower Q factor resonator;

coupling the lower Q material resonator proximate at least one of the input and output ports to a sequentially adjacent higher Q material resonator;

cross-coupling the lower Q material resonator that is proximate at least one of the input and output ports with at least one other higher Q material resonator that is proximate the inside of the sequentially-coupled arrangement and not sequentially adjacent with the lower Q material resonator proximate the input and output ports.

15. The method of claim 14 further comprising multiple lower Q resonators and wherein the resonators are arranged to provide a lower Q resonator proximate each of the input and output ports.

16. The method of claim 14 further comprising multiple higher Q resonators provided proximate the inside of the sequentially-coupled arrangement.

17. The method of claim 14 wherein the lower Q resonators are formed of metal.

18. The method of claim 14 wherein the higher Q resonators are formed of a ceramic material.

19. A filter for processing an RF signal comprising:

an input port and an output port and a plurality of resonators, each resonator including a cavity and resonant element;

the resonators arranged in a sequential arrangement between the input and output ports with adjacent resonators being coupled with each other to affect an RF signal passing through the filter;

the resonant elements of at least two resonators being made of different types of materials to provide resonators with different Q factors and at least one lower Q material resonator being proximate at least one of the input and output ports while at least one higher Q material resonator is proximate the inside of the sequential arrangement;

the lower Q material resonator being coupled with a sequentially adjacent higher Q material resonator and being cross-coupled with a non-adjacent higher Q material resonator.

20. The filter of claim 19 wherein the resonant elements are made of metal and ceramic.

21. The filter of claim 19 wherein at least some of the resonant elements are formed of metal and some are formed of a high dielectric material.

22. A method of filtering an RF signal comprising:

presenting a signal at an input port to be filtered by a plurality of resonators arranged in a sequential arrangement between the input port and an output port wherein at least one lower Q material resonator is proximate at least one of the input and output ports while at least one higher Q material resonator is proximate the inside of the sequential arrangement;

coupling the signal between a lower Q material resonator and an adjacent higher Q material resonator;

cross-coupling the signal between the lower Q material resonator and a non-adjacent higher Q material resonator.

23. The method of claim 22 wherein the resonant elements are made of metal and ceramic.

24. The method of claim 22 wherein the different non-adjacent resonators have higher and lower Q factors and further comprising arranging the resonators to provide at least one resonator having a lower Q factor proximate at least one of the input and output ports while the higher Q factor resonator is provided proximate the inside of the sequentially-coupled arrangement.

25. The method of claim 22 wherein at least some of the resonant elements are formed of metal and some are formed of a high dielectric material.

* * * * *